US006645930B1

(12) United States Patent
Wallis et al.

(10) Patent No.: US 6,645,930 B1
(45) Date of Patent: Nov. 11, 2003

(54) CLEAN ROOM WIPES FOR NEUTRALIZING CAUSTIC CHEMICALS

(75) Inventors: Danny L. Wallis, Morgan Hill, CA (US); Robert J. Small, Dublin, CA (US)

(73) Assignee: EKC Technology, Inc., Hayward, CA (US)

( * ) Notice: Subject to any disclaimer, the term of this patent is extended or adjusted under 35 U.S.C. 154(b) by 0 days.

(21) Appl. No.: 09/613,507

(22) Filed: Jul. 10, 2000

(51) Int. Cl.[7] ..... C11D 17/04; B08B 7/00

(52) U.S. Cl. ..... 510/438; 510/109; 510/110; 510/363; 510/439; 510/477; 510/488; 428/320.2; 210/501; 210/924; 210/925; 134/42; 134/6

(58) Field of Search ..... 510/438, 439, 510/109, 110, 363, 477, 488; 428/320.2; 210/501, 924, 925; 134/6, 42

(56) References Cited

U.S. PATENT DOCUMENTS

| | | | | | |
|---|---|---|---|---|---|
| 4,105,576 | A | * | 8/1978 | Seidenberger | 252/190 |
| 4,732,797 | A | * | 3/1988 | Johnson et al. | 428/74 |
| 4,769,084 | A | * | 9/1988 | Gubela | 134/7 |
| 4,781,974 | A | * | 11/1988 | Bouchette et al. | 428/288 |
| 4,975,217 | A | * | 12/1990 | Brown-Skrobot et al. | 424/404 |
| 5,141,803 | A | * | 8/1992 | Pregozen | 428/288 |
| 5,227,844 | A | | 7/1993 | Bhattacharjee et al. | 355/215 |
| 5,271,995 | A | | 12/1993 | Paley et al. | 428/224 |
| 5,279,771 | A | | 1/1994 | Lee | 252/548 |
| 5,342,543 | A | * | 8/1994 | Morris et al. | 252/190 |
| 5,381,807 | A | | 1/1995 | Lee | 134/2 |
| 5,482,566 | A | | 1/1996 | Lee | 134/42 |
| 5,562,963 | A | * | 10/1996 | Davis | 428/36.1 |
| 5,683,813 | A | * | 11/1997 | Davis | 428/400 |
| 6,197,315 | B1 | * | 3/2001 | Beerse et al. | 424/401 |

FOREIGN PATENT DOCUMENTS

| | | | | |
|---|---|---|---|---|
| EP | 336 661 | | | 10/1989 |
| EP | 0966883 | A1 | * | 12/1999 |
| JP | 05154077 | A | * | 6/1993 |
| SE | 8703015 | A | * | 2/1989 |
| WO | WO 87/06470 | A1 | * | 11/1987 |

* cited by examiner

*Primary Examiner*—Lorna M. Douyon
(74) *Attorney, Agent, or Firm*—Pennie & Edmonds LLP

(57) ABSTRACT

Clean room wipe products, methods of preparing them, and methods of using them are described. The clean room wipes are intended for use in cleaning up alkaline contaminants in clean room environments. The wipes contain impregnated acidic solutions, e.g., solutions of organic acids and optionally solvents, which are intended to reduce or eliminate the possibility of spontaneous combustion of the contaminated wipes, that is, when the wipes are used to contain spills of alkaline products such as hydroxylamine-based products and other caustic based formulations.

52 Claims, 1 Drawing Sheet

CLEAN ROOM WIPES FOR NEUTRALIZING CAUSTIC CHEMICALS

FIELD OF THE INVENTION

Figure 1:
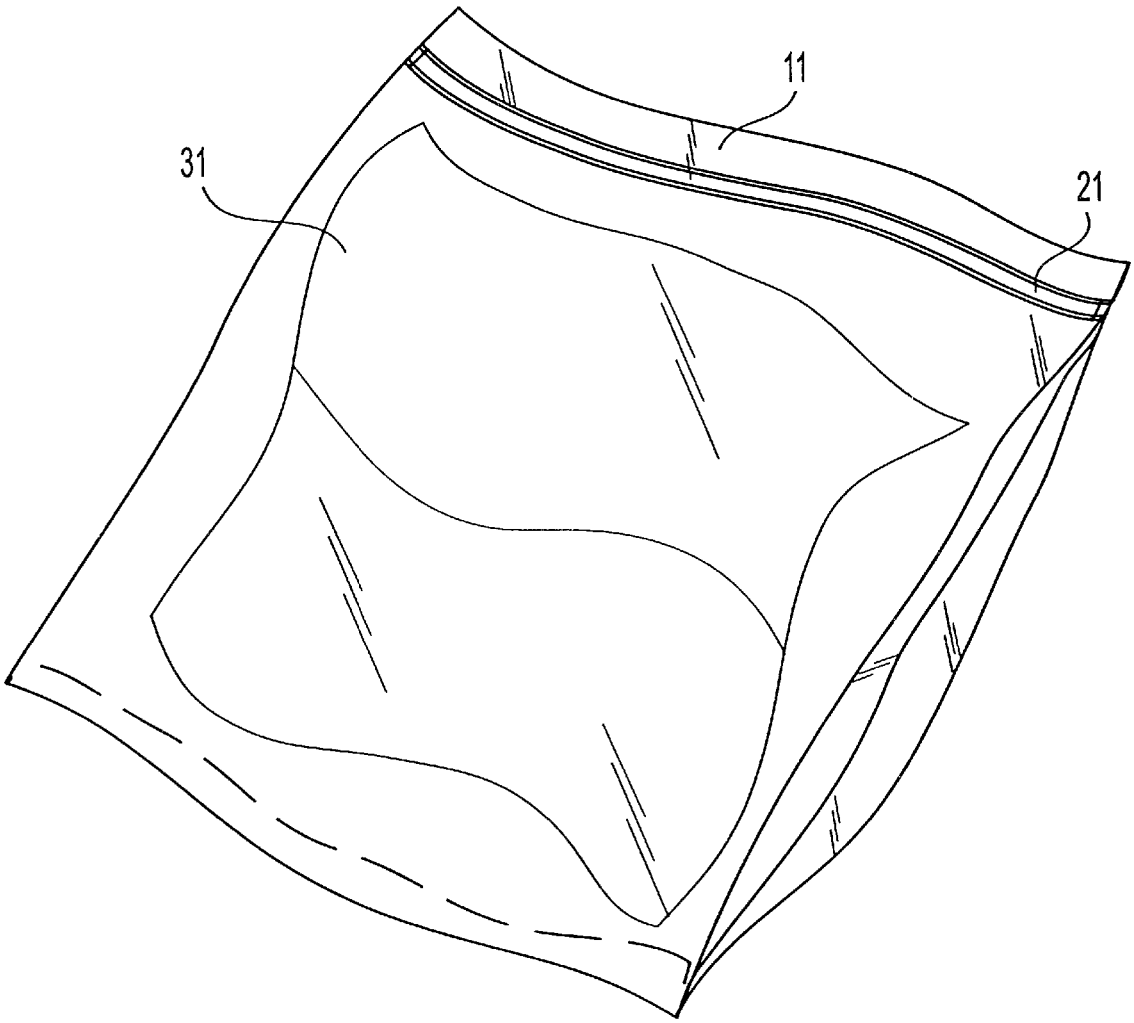

This invention relates generally to clean room wipes, and to methods for preparing and using such wipes, so as to reduce or eliminate the possible spontaneous combustion of wipes after contacting chemicals often found in clean rooms. Specifically, our invention relates to wipes used in a "clean room", semiconductor fabrication plants, metal-plating plants and in other applications and environments to clean up alkaline (caustic) spills and contaminants.

BACKGROUND OF THE INVENTION

Clean rooms are being used in a growing variety of industrial processes, especially processes such as semiconductor fabrication processes, where there are very stringent requirements for maintaining cleanliness.

Contamination, even by bits of lint or dust, can bridge these circuits and cause such devices to be defective and is a major source of rejection. Particles and contaminants, even the smallest particles and contaminants, are frequently many times larger than feature sizes in the individual transistors and diodes in microelectronic devices. Any such particles and other contaminants present during the semiconductor fabrication can cause serious functionality and reliability problems in the final manufactured devices.

Therefore, there is a need to maintain all surfaces as free from such contamination as possible. This is usually accomplished in part by wiping these surfaces, and a number of specialized wipers have been developed for this purpose. However, the wiper itself, in addition to being able to wipe cleanly, should not contribute to the problem of dust.

Clean room products, for example wipes, gloves, gowns, tools, electronic components, filters, and reactants, must be designed and manufactured to avoid contamination. Clean room wipes used in sensitive areas, such as semiconductor fabrication clean rooms and pharmaceutical manufacturing facilities, must be carefully selected for characteristics such as particle emission levels, levels of ionic contaminants, adsorptiveness, resistance to attack or degradation by wear or exposure to cleaning materials, and lack of attack by or degradation by biocides, among other factors.

Stringent clean room requirements have been met by the provision of specially fabricated products. These products include "applicators" and "wipes". These products are designed to emit very few loose particles or ions, while maintaining structural integrity when used. One example is a wipe described in EP0336 661 A2 to Paley et al. Other examples of such applicators or wipes and their method of manufacturing are described in U.S. Pat. No. 5,271,995 to Paley et al. and U.S. Pat. No. 5,227,844 to Bhattacharjee et al., the disclosures of which are incorporated herein by reference.

The contamination which is to be controlled is often called "microcontamination" because it consists of small physical contaminants, such as particulate matter of a size between that of bacteria and viruses, and chemical contaminants in very low quantities, typically expressed in parts per million or parts per billion. Clean room levels define acceptable levels of contaminants by size. Clean room levels are indicated in Table 1.

TABLE 1

Maximum Number of Particles per cubic foot of air greater than or equal to various sizes in selected classes of clean rooms

| | 0.1 micron | 0.2 micron | 0.3 micron | 0.5 micron | 5.0 micron |
|---|---|---|---|---|---|
| Class 1 | 35 | 7.5 | 3 | 1 | NA |
| Class 10 | 350 | 75 | 30 | 10 | NA |
| Class 100 | NA | 750 | 300 | 100 | NA |
| Class 1000 | NA | NA | NA | 1000 | 7 |

During normal manufacturing and maintenance operations within the clean rooms used for integrated circuit manufacturing, pharmaceutical manufacturing, and metal plating operations, there are many situations when structural surfaces must be wiped clean with either dry or saturated wipes to remove particles, ions, or chemical contamination.

Like particulates, chemical spills within clean rooms and metal plating plants are also a major concern. These chemicals will release chemical vapors, droplets (particles), and can cause corrosive damage to equipment, personnel and integrated circuit products.

During the fabrication of semiconductor devices numerous corrosive and/or reactive chemicals must be used. Very often there are chemical spills during chemical transfers to the baths or automated equipment. Such spills can also take place during the transfer of wafer boats between different tanks. Many times there are also chemical spills down the side of the containers that must be removed. These chemicals can be very hazardous to personnel, equipment and the semiconductor devices if not properly controlled.

During the metal plating operations there can be spills of corrosive and strong oxidizing solutions. These solutions are hazardous to the personnel and can also be a significant fire hazard.

Normally these chemical spills are composed of mineral acids, aromatic solvents, ketones, alcohols, amines (NMP) and alkanolamines (monoethanol amine, diglycol amine, etc.). Metal plating operations may have caustic or organic solvent based chemistries with various metal ions in different oxidized states. Wipes that are dry or saturated with water or isopropyl alcohol have heretofore been used to clean up these chemical spills.

Recently a new class of chemicals has become very important in the manufacturing of the IC devices. This class of chemicals contains hydroxylamine and hydroxylamine compounds mixed in a variety of amine and alkanolamines. The pHs of these solutions are usually between 9 to 11.5. These chemistries have proved to be very effective because of the unique reductive power of the hydroxylamine compounds. Examples of such chemistries are in such patents as U.S. Pat. Nos. 5,279,771, 5,381,807, and 5,482,566.

Prudent practices when wiping up hydroxylamine should include quenching the wipe in water before disposal. However, clean room personnel can not always be relied upon to quench these wipes. One potential problem is that when these chemistries are spilled and need to be wiped up the hydroxylamine will react with various ions and oxygen and will undergo autocatalytic oxidation. There is also the potential for an exothermic reaction between the wipe materials and the contaminant, and resulting spontaneous combustion, especially from alkaline chemistries such as hydroxylamine-based formulas. These reactions can generate thermal energy and under certain conditions can generate enough heat to allow the wipes to smolder and generate smoke and steam.

Many times clean room personnel have not adequately quenched the wipes and the spontaneous combustion has taken place.

Metal plating solutions will also have chemicals in different oxidation states that need to be neutralized to reduce the possible spontaneous combustion problems.

It is an object of the present invention to solve or alleviate the foregoing problems. Accordingly, it is an object of the invention to produce clean room products, particularly clean room wipes that can neutralize chemical spills, particularly those spills containing hydroxylamine compounds. In particular, it is an object of the invention to provide clean room wipes which can also neutralize amines, hydroxylamine, and alkanolamine, without degradation of the clean room quality of the products. It is a further object of the present invention to provide such clean room products saturated with acids that can neutralize these amines, alkanolamines and hydroxylamine and which are relatively simple to use. This invention is not intended to neutralize caustic based cyanide plating solutions, since there may be a release of the deadly hydrogen cyanide gas if the wipes of this invention were to be used for that purpose. The foregoing and other objects and advantages of the invention will be set forth in or apparent from the following description.

SUMMARY OF THE INVENTION

The wipes of our invention have an absorbent substrate containing at least one organic acid. The acid is capable of reacting with and neutralizing caustic in spilled chemicals. The absorbent substrate can be of any type known in the art to be useful for clean rooms, that is, a substrate that has stringent limits on dust and lint generation, and that is able to hold at least about 50 percent of its weight in liquids. The absorbent substrate may be a knitted, woven, and nonwoven fabrics.

The acid is an organic acid. Clean room environments often can not be exposed to concentrated ions such as would be found in a mineral acid. It is preferred that the acid or acids have an ionization constant, pKa, at 27° Centigrade, greater than 1.2, and a vapor pressure of less than 7 kPascal at 27° Centigrade. It is preferred that the acid or acids be a liquid at room temperature.

Examples of a monobasic acid include formic acid, acetic acid, propionic acid, n-butyric acid, isobutyric acid, and butyric acid. Examples of a dibasic acid include ascorbic acid, gluconic acid, malic acid, malonic acid, oxalic acid, succinic acid, and tartaric acid. Examples of a tribasic acid include citric acid and gallic acid. The preferred acids have from 1 to 7 carbon atoms and more than one carboxylic group per molecule.

A crystallization inhibitor is beneficially present to inhibit the formation of acid crystals which may be a source of dust. The crystallization inhibitor includes the solvent, and may include a co-solvent, for example a surfactant, an alcohol, a glycol, or a mixture thereof. Preferably the co-solvent has from 3 to 6 carbon atoms, more preferably from 3 to 4 carbon atoms.

The wipe is beneficially stored in a substantially air tight pouch, so that the wipe does not dry out or attract dust during handling and storage. The package or pouch may be made of a polyolefin selected from the group consisting of polyethylene, polypropylene, polybutene, poly(4-methylpentene-1), copolymers of propylene and ethylene, copolymers of ethylene and vinyl acetate, copolymers of ethylene and ethyl acrylate, and copolymers of ethylene and acrylic or methacrylic acid. The package has a thickness of from 0.5 to 10 mils.

The invention also includes a method of cleaning up caustic chemicals, particularly wherein the contaminants are amines, alkanolamines, and hydroxylamines. The method includes contacting the spilled chemical with the wipe and blotting up the spill. The wipe is then disposed of, without necessarily rinsing or quenching the wipe in water.

The invention also includes a method of cleaning up caustic chemicals in clean rooms. The method includes contacting the spilled chemical with the wipe and blotting up the spill. The wipe is then disposed of, without necessarily rinsing or quenching the wipe in water, but preferably in a sealed container.

THE FIGURES

FIG. 1 shows an exemplary liquid and air tight pouch or bag, 11, with a closable liquid and air resistant seal, 21, at one end, containing a wipe, 31 of the invention.

DETAILED DESCRIPTION OF THE INVENTION

Clean rooms are finding wider use in the manufacture, inspection and maintenance of precision products where it is essential that various operations be conducted in an environment as free of undesired small particles as possible. Clean rooms can function effectively only when every effort is taken to maintain the close control necessary to preclude contamination of the controlled environment within the clean room. Such contamination most often is generated by the worker in the clean room and by items brought into the clean room. Rigorous standards have been established, and continue to be developed, for the operation of clean rooms in such a manner as to exclude unwanted contaminants from the controlled environment.

One potential source of particulate contamination in cleanrooms has been textile articles of manufacture, including cleanroom protective garments, such as smocks, hoods, boots, masks, gloves and the like, and wipers used extensively in connection with operations carried out in the controlled environment of a cleanroom. For example, in the fabrication of semiconductor wafers, wipers are used for cleaning up spills which can occur during the procedures carried out in the controlled environment of a cleanroom. In addition, wipers are used for wiping surfaces of various equipment and items in the cleanroom, as well as for wiping down the walls and other interior surfaces of the cleanroom itself.

In clean room environments, not only is it important to maintain a "clean" environment (low particles, ion contamination, etc.) but also a "safe" clean room environment (low toxics, low carcinogens, low irritants, etc.). The use of hydroxylamines and other strong oxidizing and reducing agents in clean rooms has resulted in a auto-ignition hazard when wipes typically used in a clean room are used to clean up hydroxylamine spills. The resulting smoke will severely degrade the clean room usefulness, and may be a substantial risk to both personnel and to facilities.

While hydroxylamine compounds can, when exposed to air an in a wipe, undergo one or more heat generating reactions that has resulted in instances of auto-ignition of hydroxylamine-containing waste. The acid salts of hydroxylamine compounds do not undergo this type of spontaneous or autocatalyic oxidation reactions. Therefore if the hydroxylamine or hydroxylamine compounds (pH 9 to 11) in spills can be converted to their acid salts the residues can be disposed of safely.

The invention is a wipe, that is, an absorbent substrate, that contains an organic acid and, beneficially, a co-solvent.

The absorbent substrate can be of any type known in the art to be useful for clean rooms, that is, a substrate that has stringent limits on dust and lint generation. The use of textile articles, and especially wipers, in the controlled environment of a clean room inevitably will result in the introduction of some particles into the clean room environment. The present invention acts to assure that these particles are present in reduced quantities and are relatively benign. Therefore, particles generated within a clean room environment as a result of the use of the wipe will be less likely to have a deleterious effect upon the process being carried out in the controlled environment. For example, in the manufacture of semiconductor wafers wherein the semiconductor wafers are exposed to high temperatures as a part of the manufacturing process, it is known that various undesired particles, particularly those containing metal, can produce deleterious alterations in the configuration and operation of the semiconductor circuits. In some instances these contaminating particles produce short circuits, or they can act as spurious dopants causing deleterious alteration of the semiconductor function.

In general, particles containing only organic matter are less likely to be harmful since the organic matter in such particles essentially will be burned away during the high temperatures experienced by the semiconductor wafer during such a manufacturing process. However, particles containing inorganic matter, such as metals and metal salts, usually will leave behind inorganic matter which will not necessarily be burned off and will tend to remain with the wafer and cause deleterious effects.

A preferred material for the absorbent substrate in connection with clean room operations are synthetic polymeric materials, and particularly polymeric materials with low metals content. An absorbent substrate which has been successfully used in clean room applications and may be wetted or rendered saturated with organic acids include knitted, woven and nonwoven polyester or nylon, preferably one knitted from continuous filament yarn. This type of wipe is commercially available under the trademarks ALPHAWIPE, ALPHASORB, ALPHAL 0, and MIRACLEWIPE by the Texwipe Company, Upper Saddle River, N.J. Woven polyester or nylon fabrics also can be used.

Another absorbent substrate material is spun bond polypropylene. The fibers of these fabrics are arranged randomly and are bound together by heat or chemical action. This type of wipe is commercially available under the trademark POLYSAT by the Texwipe Company. Yet another absorbent substrate material is 55% cellulose and 45% polyester fiber or 100% polyester bound together by hydroentanglement. A typical product is the TECHNICLOTH available from the Texwipe Company. Polyurethane foam wipes, and wipes made of rayon, acrylic, abaca, (e.g., M-WIPE sold by Texwipe Company), hemp, and cotton, etc. also make acceptable absorbent substrate material. Sponges, especially synthetic sponges, can be used for high capacity wipe substrates.

The wipes of our invention have an absorbent substrate containing at least one organic acid. The acid is capable of reacting with and neutralizing caustic in spilled chemicals. Inorganic acids, for example nitric, sulfuric, and hydrochloric acids, generally have pKa between 1 to 2. Such strong acids would have high neutralization capacity, but could easily cause corrosion to the cleaned equipment, clothing and personnel. Clean room environments also often can not be exposed to concentrated ions such as would be found in a commercial mineral acid.

The preferred acid is an organic acid. The acid may have the formula $R—(Y)_a$, where a is a number ranging from 1 to 3, where Y is selected from the group consisting of —COOH, —CH2COOH, and —CHOH—COOH, and R can be —H only if a is equal to 1, or if a is equal to 1 to 3 then R is selected from the group consisting an aliphatic hydrocarbon or an aromatic hydrocarbon. The acid may also have the formula

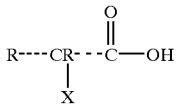

where X is an —OH, —NHR, —H, Halogen, —CO2H and —CH2—CO2H, or —CHOH—CO2H, and R is selected from the group consisting of —H, aliphatic hydrocarbons, and aromatic hydrocarbons.

Examples of a monobasic acid include formic acid, acetic acid, propionic acid, n-butyric acid, isobutyric acid, and butyric acid. Examples of a dibasic acid include ascorbic acid, gluconic acid, malic acid, malonic acid, oxalic acid, succinic acid, and tartaric acid. Examples of a tribasic acid include citric acid and gallic acid.

It is preferred that the acid or acids have an ionization constant, pKa, at 27° Centigrade, greater than 1.2, more preferably greater than 3. The pKa of representative acids are shown in Table 2. Organic acids that have higher pKa's are less corrosive, and in many cases these organic acids are used in food applications. Therefore there is a better safety margin with their use. The acidity of the acidic solution aids in maintaining the organic stability of the packaged wipers, since low pH inhibits the growth of some organisms. Since very low pH levels can result in irritation of human skin, it is preferred that the pH of the wetting liquid be greater than approximately 2.0. This level of acidity is not unusual in consumer products. For example, soft drinks have a pH level between about 2 and 4.

TABLE II

| Acids for Clean Room Wipes | pKa1 | pKa2 | pKa3 |
|---|---|---|---|
| Formic | 3.8 | | |
| Acetic | 4.8 | | |
| Propionic | 4.9 | | |
| n-butyric | 4.9 | | |
| Isobutyric | 4.8 | | |
| Benzoic | 4.2 | | |
| Ascorbic | 4.2 | 11.6 | |
| Gluconic | 3.5 | 4.7 | |
| Malic | 3.4 | 5.1 | |
| Malonic | 2.8 | 5.7 | |
| Oxalic | 1.3 | 4.3 | |
| Succinic | 4.1 | 5.6 | |
| Tartaric | 2.9 | 4.2 | |
| Citric | 3.1 | 4.8 | 6.9 |
| Gallic | 4.2 | | 8.9 |

The preferred acids have from 1 to 7 carbon atoms and more than one carboxylic group per molecule, i.e., two or three carboxylic acid groups per molecule.

The problem with highly volatile organic acids, is that they can contribute to the contamination of the clean room environment. Formic acid and acetic acid at high concentrations are less preferred. The organic acids should have a vapor pressure of less than 7 kPascal at 27° Centigrade, preferably less than about 1 kpascal at 27° Centigrade.

It is preferred that the acid be in a liquid state at room temperature. The term "in a liquid state" includes acids that are normally a solid at room temperature, but insofar as the invention is concerned the acid is in a liquid state if it is dissolved in a solvent or solvents such that the solution is stable at room temperature. While many of these acids are a solid at room temperature, it is preferred that the acid or acids be in solution and be a liquid at room temperature. The acids may be dissolved in water. Concentrations can vary from about 1 to about 25 weight percent organic acid in water or other solvent. The important factor is the solubility of the acid and base products with any additional agents in the aqueous solutions. A related consideration is that the acid not form crystals within the wipe during storage since this would cause the release of particles when the sealed pouch containing the wipes was opened. Such particles could contaminate the clean room environment. Acids such as citric, gallic, malonic, tartaric, oxalic etc. could form these crystals if only water was used.

While water is a preferred solvent, other solvents besides water can be used to make up the organic acid solutions. Alternatively, water and a co-solvent can be combined. A crystallization inhibitor is beneficially present to inhibit the formation of acid crystals which may be a source of dust. The crystallization inhibitor may be a co-solvent, for example an alcohol, a glycol, or a mixture thereof. The crystallization inhibitor may be a co-solvent chosen from the group consisting of glycols and alcohols and having from 3 to 6 carbon atoms, more preferably from 3 to 4 carbon atoms. The crystallization inhibitor may also comprise a surfactant, for example, a non-ionic, a cationic, or an anionic surfactant. Preferably the surfactant has from 3 to 6 carbon atoms. Examples of other solvents or co-solvents include propylene glycol, ethylene glycol or alcohols, preferably containing between about 3 to 6 carbon atoms per molecule. These co-solvents have very low evaporation rates compared to water for example, propylene glycol has a vapor pressure of 0.02 kPascal, and water has a vapor pressure of 3.2 kpascals, at 25° C. There is less likelihood that the organic acids would form crystals in such a fluid due to evaporation of the solvent.

The acid should, of course, be chemically stable and soluble in acidic solution that comprises the solvent and one or more co-solvents. Exemplary surfactants are those selected from the group consisting of glycols and alcohols. Further, the acids must be compatible with the absorbent substrate material for very long-term storage.

The amount of impregnated organic will of course be a function of the concentration of the acid in the solvent or cosolvents as well as the total amount of acidic solution added to the absorbent material. This amount of acidic solution is in turn dependent on the absorbent capacity of the substrate. Typically, the amount of impregnated organic acid solution can range between 10% and 80% and is preferred to be 50 to 70% by weight of substrate.

It is generally preferred that the organic acid solution occupy between about 10 percent to about 80 percent of the absorbent capacity of the substrate. Preferably, the organic acid solution occupies between about 20 percent to about 70 percent of the absorbent capacity of the substrate. Even more preferably, the organic acid solution occupies between about 30 percent to about 60 percent of the absorbent capacity of the substrate.

In some embodiments, the absorbent substrate is approximately saturated with the acidic solution. This provides a maximum dilution and neutralization effect, but substantially reduces the capacity of the wipe to absorb spills. In another embodiment, the acid solution is added to the absorbent substrate in an amount less than the absorbent capacity of the absorbent substrate.

Beneficially, the concentration of acid in the acid solution is controlled so that if the wipe is subsequently saturated with, for example, an hydroxylamine, the quantity of acid in the wipe will be sufficient to combine with, and make neutral salts with, at least 70 percent of the hydroxylamine in the wipe. More beneficially, the concentration of acid in the acid solution is controlled so that if the wipe is subsequently saturated with hydroxylamine the quantity of acid in the wipe will be sufficient to combine with at least 100 percent of the hydroxylamine in the wipe. In some embodiments, the concentration of acid in the acid solution is controlled so that if the wipe is subsequently saturated with hydroxylamine the quantity of acid in the wipe will be sufficient to combine with at least 120 percent of the hydroxylamine in the wipe. This allows for some excess acid to be lost from the wipe during the cleaning operation. It is within the ability of one of ordinary skill in the art, with the benefit of this disclosure, to determine the absorbent capacity of a wipe and the resulting quantity and concentration of acid solution needed to neutralize the desired fraction of hydroxylamine that the wipe may subsequently hold.

In another embodiment of the invention, the solvent and/or cosolvents, the amount of acid solution impregnated on the wipe, and the concentration of acid in the acidic solution are controlled such that the acidic salts of the hydroxylamines or the hydroxylamine compounds will not form crystals once combined with the acidic solution in the wipe.

The time period for saturating the wipe during manufacturing can be any amount of time, for example ranging from about 0.1 hours to about 0.5 hours, preferably from about 0.1 hours to about 0.15 hours. The time of treatment can be varied to an even greater extent, for example, by varying the concentration of the acids in impregnating acidic solution, the amount of wipes added to the solution, the temperature of the impregnating step and the amount of agitation. For example, it may be desirable to impregnate the center of the thickness of a wipe with a more acidic acid solution than the concentration desired on the outside edges of the thickness of a wipe, both to minimize acid that may contact people and/or surfaces as well as to minimize the possibility of acid crystal formation due to evaporation of solvent.

Surfactants (nonionics, anionics and cationics) can be included in these formulations. Though the surface tensions for the organic aid solutions will typically be between 60–70 dynes/cm, there maybe special situations where the surface tension needs to be reduced.

In another embodiment of the invention, a suitable pH indicator is added concentration between 0.001% and 0.1% to the acidic solution. The preferred pH indicator would change color between a pH range of 5 to 8. Suitable pH indicators include Bromocresol Purple, Chlorophenol Red, Alizarin, and Phenol Red. A wipe containing the pH indicator will change color upon blotting up caustic, and the color will remain changed if there is insufficient acid within the wipe to neutralize the caustic.

The wipe is beneficially stored in a substantially air tight pouch, so that the wipe does not dry out or attract dust during handling and storage. The package or pouch may be made of a polyolefin selected from the group consisting of polyethylene, polypropylene, polybutene, poly(4-methylpentene-1), copolymers of propylene and ethylene, copolymers of ethylene and vinyl acetate, copolymers of ethylene and ethyl acrylate, and copolymers of ethylene and acrylic or methacrylic acid. The package has a thickness of from 0.5 to 10 mils.

The acid bearing clean room wipes are preferably packaged in liquid-tight and air-tight plastic bags or pouches. Exemplary liquid tight, air tight plastic bags are the clear, polyolefin plastic bags, fabricated from, for example, polyethylene, polypropylene, polybutene, poly(4-methylpentene-1), copolymers of propylene and ethylene, copolymers of ethylene and vinyl acetate, copolymers of ethylene and ethyl acrylate, and/or copolymers of ethylene and acrylic or methacrylic acid. The polyolefin generally has a thickness of from about 0.5 to about 10 mils, and preferably from about 1 to about 5 mils.

It is possible to use food storage bags fabricated from polyethylene and having a thickness of from about 0.5 to about 10 mils, and preferably from about 1 to about 5 mils, and further characterized by a sealing, locking, or closure structure at one end or edge of the bag. FIG. 1 shows an exemplary liquid and air tight pouch or bag, 11, with a closable liquid and air resistant seal, 21, at one end, containing a wipe, 31. The resulting package contains a wipe, 31, in accordance with the invention. That is, the wipe, 31, has an absorbent substrate containing (i) an organic acid and (ii) a crystallization inhibitor for the organic acid. The acid is an organic acid having the formula previously described. The crystallization inhibitor to inhibit the formation of acid crystals may be a surfactant, and the absorbent substrate of the wipe, 31, is a fabric chosen from the group consisting of knitted, woven, and nonwoven fabrics.

Generally, the invention includes a method of decontamination of an environment by contacting the contaminants with an absorbent wipe, where the wipe is in the form of an absorbent substrate containing compound capable of reacting with contaminants.

More particularly, the invention also includes a method of cleaning up caustic materials. The caustic materials that can be neutralized could include any material with pH's greater than about 8, and include specifically amines, alkanolamines, and hydroxylamine compounds. It is particularly important to form the acid salts of hydroxylamine compounds. This is because the acid salts of the hydroxylamine compounds do not undergo spontaneous or autocatalyic oxidation reactions. The hydroxylamine or hydroxylamine compounds (pH 9 to 11) that are converted to their acid salts can be disposed of safely. The method includes contacting the spilled caustic material, i.e., hydroxylamine or hydroxylamine compounds, with the wipe and blotting up the spill. The wipe is then disposed of, without necessarily rinsing or quenching the wipe in water.

Even more particularly, the invention includes a method of cleaning up alkaline or caustic chemicals in clean room environments. By a clean room environment is generally meant an environment characterized by less than 100 particles greater than 0.5 micron in diameter per cubic foot of air, and less than 300 particles greater than 0.3 micron in diameter per cubic foot of air. The wipes of our invention have an absorbent substrate containing an organic acid. The method includes contacting the spilled chemical with the wipe and blotting up the spill. The wipe is then disposed of, without necessarily rinsing or quenching the wipe in water, but preferably in a sealed container.

A further aspect of our invention is a method of preparing the wipe by impregnating a suitable substrate material with a suitable acid. The wipes of our invention have an absorbent substrate containing an organic acid. Clean room wipes with adequate absorbency can be impregnated with organic acids. The absorbent substrate is a fabric chosen from the group consisting of knitted, woven, and nonwoven fabrics. The organic acid is preferred to be in a liquid state under normal room temperature conditions, with a vapor pressure of less than 7 kpascal at 27 degrees Centigrade. The term "in a liquid state" includes acids that are normally a solid at room temperature, but insofar as the invention is concerned the acid is in a liquid state if it is dissolved in a solvent or solvents.

The presently disclosed neutralization clean room wipe products provide for the neutralization of caustic chemistries spilled in clean rooms. The caustic chemistries can be any chemical with a pH greater than 8. The invention is more specific for amines, alkanolamines and hydroxylamine compounds.

The organic acid may be (mono-, di-, or trifunctional) with the total number of carbons preferably between 1 to 7. Most commonly the organic acid is a monobasic acid chosen from the group consisting of formic acid, acetic acid, propionic acid, n-butyric acid, isobutyric acid, and butyric acid, or a dibasic acid chosen from the group consisting of ascorbic acid, gluconic acid, malic acid, malonic acid, oxalic acid, succinic acid, and tartaric acid, or a tribasic acid chosen from the group consisting of citric acid and gallic acid. Bi- and trifunctional acids are preferred. The organic acid is further characterized by an ionization constant, pKa, at 27 degrees Centigrade, greater than 1.2.

A further aspect of our invention is the provision of a method of removing contaminants from each of the clean room environments described in Table 1, for example, an environment characterized by less than 100 particles greater than 0.5 micron in diameter per cubic foot of air, and less than 300 particles greater than 0.3 micron in diameter per cubic foot of air. According to the method of decontamination of our invention, the contaminants are contacted with an absorbent wipe, where the wipe is in the form of an absorbent substrate containing an acid capable of reacting with contaminants.

A further aspect of the invention is the provision of a method of cleaning ferric nitrate stains from chemical mechanical polishing tools. These stains are formed when the oxidizer, ferric nitrate, is used for tungsten polishing in the semiconductor industry. Some of the oxidizer can be splashed onto the polishing equipment and will dry as ferric nitrate, ferric oxides and ferric hydroxide compounds, and will contain slurry particles. It is necessary to remove these stains at certain intervals so that these contaminates will not interfere with the polishing process by causing subsequent damage to other polished wafers.

Yet another aspect of the invention is a kit comprising a wipe that contains an organic acid and a spray bottle that contains additional organic acid. The acid solution in the spray bottle need not be the same as the acid solution in the wipe. The acid solution can be dispensed from spray bottles, which is especially useful for the cleaning of chemical mechanical polishing polishing tools, drums and other large or complex surface structures.

When a spill of hydroxylamine-type products occurs an acid impregnated wipe, as described above, is removed from the sealed pouch and wiped across the spill until the wipe becomes saturated. Additional wipes can be used to remove the caustic hydroxylamine chemistries. The wipes must be disposed of into the proper waste container. The neutralized residues will not be prone to undergo spontaneous combustion.

The following examples are illustrative of some the methods for preparing the wipes with organic acids that fall within the scope of the present invention. They are, of course, not to be considered in any way a limitation of the invention. Numerous changes and modification can be made with respect to the invention including the selection of the acid, solvents and possible surfactants, ranges of proportions, time and temperature during operations and the like.

EXAMPLES

Example 1

A solution containing 25 parts propionic acid and 75 parts water is used to partially saturate a standard absorbent clean room wipe. The wipe is allowed to soak for 10 minutes, is removed from the solution, and is allowed to drain. The wipe is not allowed to dry, but is sealed in a "pouch" for storage.

Example 2

A solution containing 20 parts citric acid, 10 parts propylene glycol and 70 parts water is used to saturate a standard absorbent clean room wipe. The wipe is allowed to soak for 10 to 15 minutes, is removed from the solution, and is allowed to drain. The wipe is then sealed in a "pouch" for storage, as shown in FIG. 1.

Example 3

A solution containing 2 parts acetic acid, 18 parts citric acid, 5 parts malonic acid, 5 parts propylene glycol and 70 parts water is used to saturate a standard absorbent clean room wipe. The wipe is treated as before.

Example 4

A solution containing 90 parts of a approximately 92% aqueous lactic acid solution and 10 parts of propylene glycol is used to saturate a clean room wipe. The wipe is treated as before.

Example 5

Paper towels were wetted with citric acid solutions. The wetted towels were then used to wipe up an hydroxylamine-, alkanolamine-, and catechol-containing cleaner, EKC265 available from EKC Technology Inc. of Heyward, Calif. No secondary autooxidation heat was detected after the heat of neutralization dissipated. The deep red solution color was considerably reduced because the active components were in the acid form.

Each of these wipes is used to blot up a spill of an hydroxylamine compound. No evidence of auto-oxidation is observed.

While the invention has been described with respect to certain preferred embodiments and exemplifications, these embodiments and exemplifications are not intended to limit the scope of the invention as defined by the claims appended hereto.

We claim:

1. An acid-impregnated wipe comprising:

an absorbent substrate selected from the group consisting of knitted, woven, and nonwoven fabrics and is adapted for use in removing alkaline contaminants from a clean room environment;

an organic acid; and an organic acid crystallization inhibitor, wherein the organic acid and organic acid crystallization inhibitor form a liquid at room conditions and wherein the acid-impregnated wipe has an absorbent capacity.

2. The wipe of claim 1 wherein the crystallization inhibitor comprises a solvent.

3. The wipe of claim 2 wherein the solvent comprises water.

4. The wipe of claim 2 wherein the organic acid comprises at least one dibasic acid or tribasic acid.

5. The wipe of claim 4 wherein the organic acid comprises, citric acid, gallic acid, or a mixture thereof.

6. The wipe of claim 4 wherein the organic acid is selected from the group consisting of ascorbic acid, gluconic acid, malic acid, malonic a oxalic acid, succinic acid, and tartaric acid.

7. The wipe of claim 1 wherein the crystallization inhibitor comprises water and an alcohol, water and a glycol, or a mixture thereof.

8. The wipe of claim 7 wherein the alcohol and/or the glycol has between 3 to 6 carbon atoms.

9. The wipe of claim 8 wherein the alcohol and/or the glycol has between 3 to 4 carbon atoms.

10. The wipe of claim 1 wherein the organic acid is a liquid at room conditions, and has a vapor pressure of less than 7 kPascal at 27° Centigrade.

11. The wipe of claim 1 wherein the organic acid is a liquid at room conditions, and wherein at least one organic acid has an ionization constant at 27° Centigrade of greater than about 3 and a vapor pressure of less than 1 kPascal at 27° Centigrade.

12. The wipe of claim 1 wherein the volume of the organic acid and crystallization inhibitor is about 10 percent to about 70 percent of the absorbent capacity of the absorbent substrate.

13. The wipe of claim 1 wherein the weight of the organic acid and crystallization inhibitor is between 10 percent add about 80 percent of the weight of the substrate.

14. The wipe of claim 1 wherein the weight of the organic acid and crystallization inhibitor is between 50 percent and about 70 percent of the weight of the substrate.

15. The wipe of claim 1 wherein the quantity of organic acid is sufficient to neutralize at least about 70 percent of a quantity of a hydroxylamine of a volume equal to the absorbent capacity of the acid-impregnated absorbent substrate.

16. The wipe of claim 1 wherein the quantity of organic acid is sufficient to neutralize at least about 100 percent of a quantity of a hydroxylamine of a volume equal to the absorbent capacity of the acid-impregnated absorbent substrate.

17. The wipe of claim 1 wherein the quantity of organic acid is sufficient to neutralize at least about 120 percent of a quantity of a hydroxylamine of a volume equal to the absorbent capacity of the acid-impregnated absorbent substrate.

18. The wipe of claim 1 wherein the organic acid is in solution in the crystallization inhibitor, and wherein the concentration of organic acid in the solution is between about 1 percent to about 25 percent by weight.

19. The wipe of claim 1 wherein the organic acid and organic acid crystallization inhibitor solution is present in an amount between about 10 percent to about 80 percent of the absorbent capacity of the substrate.

20. The wipe of claim 1 wherein the organic acid and organic acid crystallization inhibitor solution is present in an amount between about 20 percent to about 70 percent of the absorbent capacity of the substrate.

21. The wipe of claim 1 wherein the organic acid and organic acid crystallization inhibitor solution is present in an amount between about 30 percent to about 60 percent of the absorbent capacity of the substrate, and wherein the quantity of organic acid is sufficient to neutralize at least about 100 percent of a quantity of a hydroxylamine of a volume equal to the absorbent capacity of the solution-impregnated absorbent substrate.

22. the wipe of claim 1 further comprising a pH indicator.

23. The wipe of claim 1 further comprising a sealable air-tight plastic bag, wherein the acid-impregnated wipe is contained in the sealed bag prior to use.

24. The wipe of claim 23 wherein the air-tight bag comprises a polyolefin selected from the group consisting of polyethylene, polypropylene, polybutene, poly(4-methylpentene-1), copolymers of propylene and ethylene, copolymers of ethylene and vinyl acetate, copolymers of ethylene and ethyl acrylate, and copolymers of ethylene and acrylic or methacrylic acid, and wherein the polyolefin has a thickness of from about 0.5 to about 10 mils.

25. An acid-impregnated wipe comprising:

an absorbent wipe selected from the group consisting of knitted, woven, and nonwoven fabrics, wherein the absorbent substrate has a first absorbent capacity;

a first organic acid;

a first solvent; and an organic acid crystallization inhibitor, wherein said acid-impregnated wipe has a remaining absorbent capacity which is less than the first absorbent capacity, the wipe is adapted for use in removing alkaline contaminant composition from a clean room environment, and wherein the organic acid, solvent, and the crystallization inhibitor form a liquid composition at room conditions.

26. The wipe of claim 25 wherein the crystallization inhibitor comprises a second solvent, wherein said second solvent is different from said fist solvent.

27. The wipe of claim 25 wherein the absorptive capacity of the wipe is such that, when the remaining absorptive capacity of the acid-impregnated wipe is filled with an alkaline contaminant composition containing hydroxylamine and/or hydroxylamine compounds such that the alkaline contaminant composition is combined with the liquid composition in the wipe, the acid in the acid-impregnated wipe and the hydroxylamine and/or hydroxylamine compounds form acidic salts of the hydroxylamines or the hydroxylamine compounds, and the acidic salts will not form crystals.

28. The wipe of claim 25 wherein the wipe is constructed so that it releases microcontamination particles, when used to absorb B caustic substance in a clean room environment, in an amount less than the amount which would provide 100 microcontamination particles greater than 0.5 micron in diameter per cubic foot of clean room air.

29. The wipe of claim 25 wherein the wipe comprises the organic acid in a quantity sufficient to neutralize at least about 100 percent of a quantity of an alkaline contaminant composition of a volume equal to the remaining absorbent capacity of the acid-impregnated wipe.

30. The wipe of claim 25 wherein the liquid composition further comprises a second organic acid, wherein the second organic acid is different from the first organic acid.

31. An acid-impregnated clean room wipe comprising:

means to absorb a liquid caustic, said means to absorb a liquid caustic being adapted for use in a clean room environment and having a first absorbent capacity;

means to neutralize an absorbed caustic liquid composition, said means to neutralize an absorbed caustic being absorbed in the means to absorb a liquid caustic; and means to inhibit crystallization of the means to neutralize an absorbed caustic liquid composition, wherein said clean room wipe containing said means to neutralize an absorbed caustic liquid composition and said means to inhibit crystallization has a remaining absorbent capacity which is less than the first absorbent capacity and is adapted to absorb and at least partially neutralize the absorbed caustic liquid composition, and wherein the means to neutralize an absorbed caustic liquid composition and the means to inhibit crystallization of the means to neutralize an absorbed caustic liquid composition form a liquid composition at room conditions.

32. The acid-impregnated wipe of claim 31 wherein the liquid composition further comprises a solvent different from the means to inhibit crystallization of the means to neutralize an absorbed caustic liquid composition.

33. The acid-impregnated wipe of claim 31 wherein the means to neutralize an absorbed caustic is a fluid composition comprising between a 3.1 and a 9.2 Normal solution of organic acid or acids.

34. The acid-impregnated wipe of claim 31 wherein the means to neutralize an absorbed caustic is a fluid composition comprising about 20 and about 82.8 parts of organic acid per hundred parts of the fluid composition.

35. The acid-impregnated wipe of claim 31 wherein the means to neutralize an absorbed caustic is a fluid composition comprising between a 1 to 9.2 molar solution of organic acid or acids, and the fluid composition is present in an amount between about 30 percent to about 60 percent of the first absorbent capacity.

36. The acid-impregnated wipe of claim 31 wherein the means to neutralize an absorbed caustic is a fluid composition comprising between about 20 and about 25 parts of organic acid per hundred parts of the fluid composition.

37. The acid-impregnated wipe of claim 31 wherein the means to neutralize an absorbed caustic is a fluid composition comprising a first organic acid and a second organic acid, and wherein at least one of the first And second organic acids is a liquid at room conditions.

38. An acid-impregnated wipe comprising:

an absorbent wipe with low metals content and having particle emission during use being acceptable for use in a clean room and is adapted for use in removing an alkaline contaminant composition from a clean room environment, wherein the wipe has an absorbent capacity;

a neutralizing composition absorbed in the wipe, the neutralizing composition being a liquid having at least one organic acid and a solvent such that the normality of the organic acid in the neutralizing composition is between about 3.1 and 9.2, and wherein the neutralizing composition is present in an amount between about 10 percent to about 80 percent of the absorbent capacity of the wipe such that the acid-impregnated wipe is operable to absorb the alkaline contaminant composition.

39. The acid-impregnated wipe of claim 38 wherein the neutralizing composition comprises a first organic acid and a second organic acid, and wherein at least one of the first and second organic acids is a liquid at room conditions.

40. The acid-impregnated wipe of claim 38 wherein the neutralizing composition is between a 3.1 and 4.1 Normal solution of organic acid or acids, and the neutralizing composition further comprises an organic acid crystallization inhibitor.

41. The acid-impregnated wipe of claim 38 wherein the neutralizing composition comprises between about 20 and about 82.8 parts of organic acid per hundred parts of the neutralizing composition, and the neutralizing composition is present in an amount between about 20 percent to about 70 percent of the absorbent capacity of the wipe.

42. The acid-impregnated wipe of claim 38 wherein neutralizing composition comprises between about 20 and about 25 parts of organic acid per hundred parts of the neutralizing composition.

43. A method of cleaning a caustic spill in a clean room comprising contacting the spilled caustic material with the acid-impregnated wipe of claim 1, said wipe characterized by an absorbent substrate consisting of knitted, woven, and nonwoven fabrics, wherein the absorbent substrate has an absorbent capacity, and an organic acid solution in an amount less than the absorbent capacity of the absorbent substrate;

moving the wipe across the caustic material to allow the wipe to blot at least a portion of the caustic material; and disposing the wipe.

44. The method of claim 43, wherein the caustic material is selected from the group consisting of amines, alkanolamines, hydroxylamines, and mixtures thereof.

45. A method of cleaning a caustic spill in a clean room comprising contacting the spilled caustic material with the acid-impregnated wipe of claim 25, said wipe characterized by an absorbent substrate consisting of knitted, woven, and nonwoven fabrics, wherein the absorbent substrate has an absorbent capacity, and an organic acid solution in an amount less than the absorbent capacity of the absorbent substrate;

moving the wipe across the caustic material to allow the wipe to blot at least a portion of the caustic material; and disposing the wipe.

46. The method of claim 45, wherein the caustic material is selected from the group consisting of amines, alkanolamines, hydroxylamines, and mixtures thereof.

47. A method of cleaning a caustic spill in a clean room comprising contacting the spilled caustic material with the acid-impregnated wipe of claim 38, said wipe characterized by an absorbent substrate consisting of knitted, woven, and nonwoven fabrics, wherein the absorbent substrate has an absorbent capacity, and an organic acid solution in an amount less than the absorbent capacity of the absorbent substrate;

moving the wipe across the caustic material to allow the wipe to blot at least a portion of the caustic material; and disposing the wipe.

48. The method of claim 47, wherein the caustic material is selected from the group consisting of amines, alkanolamines, hydroxylamines, and mixtures thereof.

49. A method of manufacturing an acid impregnated wipe product comprising the steps of:

providing a wipe adapted for use in a clean room;

contacting the wipe with a liquid containing an organic acid and an organic acid crystallization inhibitor to provide an acid-impregnated wipe of claim 1; and sealing the wipe in an airtight bag.

50. The method of claim 49, wherein the organic acid has an ionization constant at 27° Centigrade of greater than about 3 and a vapor pressure of less than 1 kPascal at 27° Centigrade.

51. The method of claim 49, wherein the crystallization inhibitor comprises water and alcohol, water and glycol, or a mixture thereof.

52. A method of cleaning a ferric nitrate stain from chemical mechanical polishing tools comprising wetting the stain with a liquid solution of an organic acid;

contacting the wetted stain with an acid-impregnated wipe of claim 1, said wipe comprising an absorbent substrate selected from the group consisting of knitted, woven, and nonwoven fabrics, wherein the absorbent substrate has an absorbent capacity, and an organic acid solution in an amount less than the absorbent capacity of the absorbent substrate;

moving the wipe across the ferric nitrate stain to allow the wipe to blot at least a portion of the ferric nitrate stain; and disposing the wipe.

* * * * *